United States Patent [19]

Johnson et al.

[11] 4,004,489

[45] Jan. 25, 1977

[54] DUAL SELECTIVE FEED MECHANISM FOR AUTOMATIC WEAPONS

[75] Inventors: Curtis D. Johnson; Fred J. Skahill, both of Davenport, Iowa

[73] Assignee: The United States of America as represented by the Secretary of the Army, Washington, D.C.

[22] Filed: Nov. 3, 1975

[21] Appl. No.: 628,032

[52] U.S. Cl. ..... 89/33 SF; 89/33 CA

[51] Int. Cl.[2] ..... F41D 9/02

[58] Field of Search ..... 89/33 SF, 33 BC, 33 CA

[56] References Cited

UNITED STATES PATENTS

| | | | |
|---|---|---|---|
| 2,395,211 | 2/1946 | Bell et al. | 89/33 CA UX |
| 3,277,787 | 10/1966 | Brieger | 89/33 CA |
| 3,611,868 | 10/1971 | Hupp | 89/33 SF |
| 3,611,869 | 10/1971 | Hupp | 89/33 SF |
| 3,766,825 | 10/1973 | Robinson | 89/33 SF |

FOREIGN PATENTS OR APPLICATIONS

| | | | |
|---|---|---|---|
| 1,142,380 | 5/1969 | United Kingdom | 89/33 SF |

*Primary Examiner*—David H. Brown
*Attorney, Agent, or Firm*—Nathan Edelberg; Harold H. Card, Jr.; Robert O. Richardson

[57] ABSTRACT

An easily employed, reliable, rapid response and simple multiple feed system for selectively feeding various belts of varied types of ammunition through the same gun. A round selector cam pivots the rammer on the bolt carrier to a position for chambering cartridges from the selected belt. A dual feed mechanism advances the cartridges from the selected belt while those from the non-selected belt are held ready but not advanced.

10 Claims, 5 Drawing Figures

DUAL SELECTIVE FEED MECHANISM FOR AUTOMATIC WEAPONS

GOVERNMENT INTEREST

The invention described herein may be manufactured and/or used by or for the Government for governmental purposes without the payment of any royalty thereon.

BACKGROUND OF THE PRESENT INVENTION

It is desirable to broaden the application and effectiveness of weapon systems by providing rapid employment of a variety of ammunition appropriate for specific combat target conditions. A wide spectrum of projectiles is available for such a rapid exchange in the field. For example, a gunner may wish to use armor piercing, tracer, incendiary or anti-personnel ammunition and then have a need to convert quickly to another type while maintaining the first in a state of readiness.

SUMMARY OF THE PRESENT INVENTION

In accordance with the present invention a dual selective feed mechanism has been developed for automatic weapons within a space envelope equivalent to that of a conventional feed mechanism. The feed selection (right hand, left hand or no feed) is accomplished through a simple hand motion of a selector which is conveniently located at the rear of the receiver. On recoil the selector pivots the rammer in a direction to strip a cartridge from the desired belt as the bolt slide counterrecoils to chamber this cartridge. A sensor detects this stripping and activates the feed mechanism to move the next round into position. In the non-selected feed mechanism the cartridge is not stripped and, accordingly, the sensor does not activate this feed mechanism for the next round since the preceding cartridge still remains to be stripped.

Feeding guides are cut into the feeding sprockets to guide the selected cartridge into chamber position. As the rammer continues to move forward to chamber the round, the rammer pivots to a position parallel to the path of movement of the bolt carrier upon which it is mounted. On recoil the rammer is pivoted by the selector in a direction to strip the next cartridge from the selected feed mechanism on the counterrecoil or chambering stroke.

To change selection of rounds, the selector is simply moved to direct the rammer to a new position to strip the next cartridge from the newly selected belt while the sensor deactivates the non-selected belt of ammunition.

DETAILED DESCRIPTION OF PREFERRED EMBODIMENT

Figure 1:
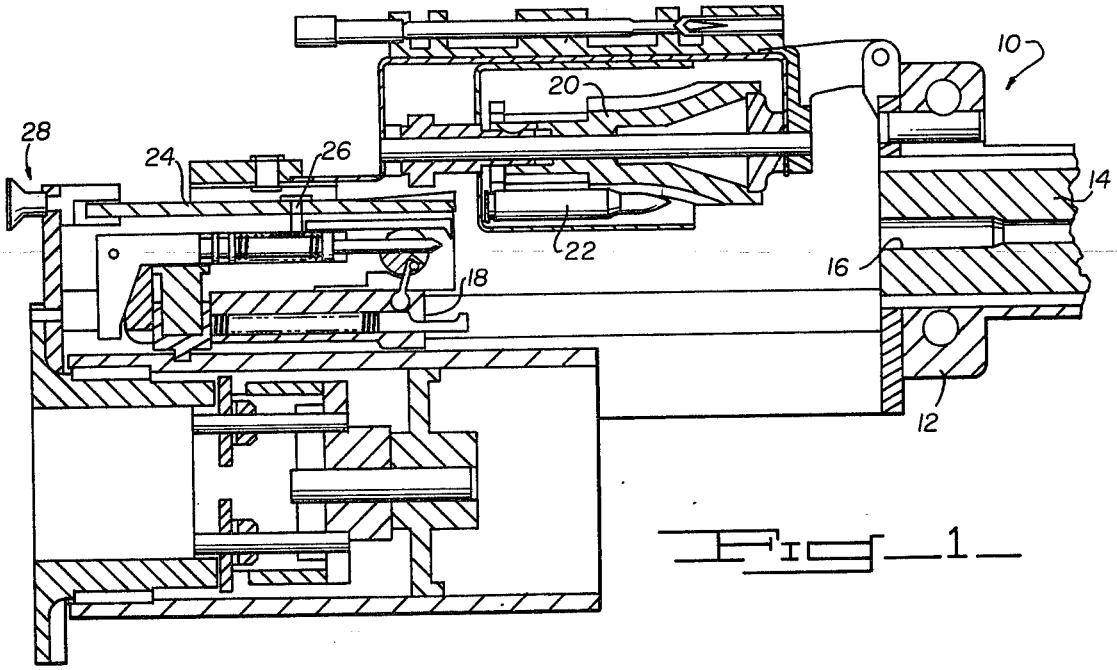
FIG. 1 is a side elevational view in section of a gun using the dual selective feed mechanism of the present invention.

Referring now to FIG. 1 there is shown in cross-section a portion of an automatic weapon 10 comprising a receiver 12, barrel 14, chamber 16, bolt carrier 18, and feed sprocket assembly 20. This sprocket rotates to place a cartridge 22 in position for a rammer 24 on the bolt carrier 18 to strip the cartridge and chamber it when the carrier 18 moves forwardly to its battery position. As will be more apparent hereinafter, there are two sets of feed sprocket assemblies 20 and a rammer 24 pivotally mounted at 26 to bolt carrier 18. A feed selector 28 is set by operator to pivot rammer 24, as the bolt carrier 18 recoils, to strip and chamber cartridges from the desired feed assembly while the non-selected feed assembly is inoperative but ready.

Figure 2:
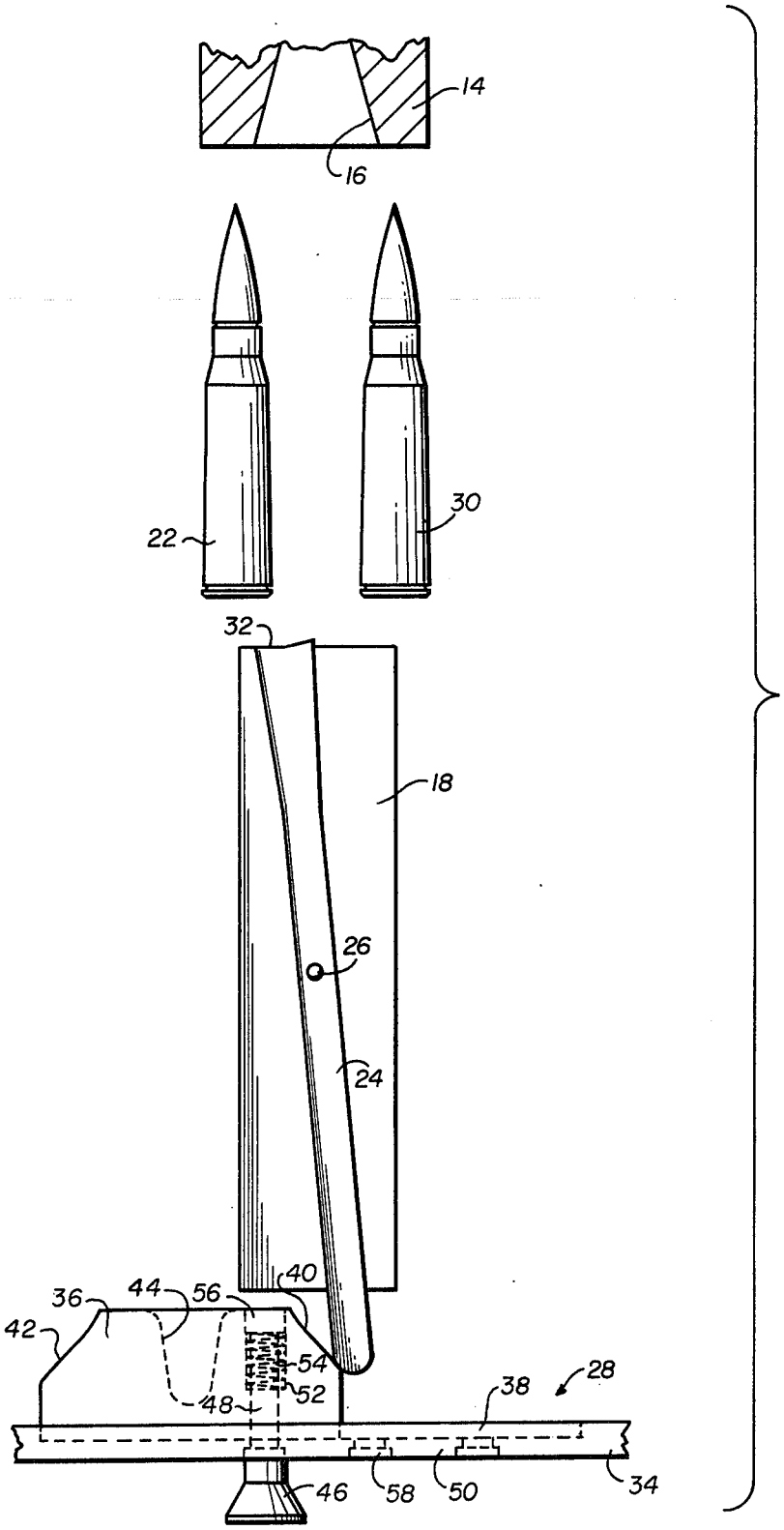
FIG. 2 is a plan view schematically illustrating the operation of the selector.

In FIG. 2 the two sprocket assemblies are not shown but cartridges 22 and 30 are shown in a position to be stripped and chambered. Cartridge 22 is from the selected feed assembly whereas cartridge 30 is from the non-selected feed assembly but in a state of readiness. Bolt carrier 18 is in recoil position, ready to advance to battery position.

As can be seen, rammer 24 is pivoted at 26 on bolt carrier 18 so that its forward tip 32 engages cartridge 22 when the bolt carrier 18 moves forwardly to battery position.

The feed selector 28 includes a bracket 34 mounted on the receiver with a round selector cam 36 adjustably mounted in a groove 38 therein. This groove is laterally extending to permit lateral movement of the cam 39. This cam 39 has two inclined surfaces 40, 42 and a recessed portion 44, each of which may be moved into alignment with the bolt axis and rearwardly of rammer 24 when the rammer is parallel with the axis of the bolt carrier 18. Thus, when bolt carrier 18 recoils rearwardly, the position of the feed selector cam 34 determines whether the gun is in a left hand feed, right hand feed, or no feed condition. With the cam 36 positioned as shown, rammer 24 hits inclined surface 40 as bolt carrier 18 recoils, and pivots to place rammer tip 32 behind cartridge 22, as shown.

If selector cam 36 were moved laterally to the right so that inclined surface 42 was positioned rearwardly of the bolt carrier 18, then rammer tip 32 would be pivoted to a position rearwardly of cartridge 30 for a right hand feed. Similarly, when recessed portion 44 is aligned with the bolt receiver 18, rammer 24 remains parallel with the receiver and tip 32 passes between the cartridges 22, 30 and neither are chambered. This position is used for purging the system of unspent rounds, checking for cycle, etc.

It should be noted that as rammer 24 strips and chambers a cartridge from either side, the rammer is parallel with the axis of the bolt carrier 18 when it chambers the cartridge and recoils. When it strikes the cam 36 it then pivots in a direction determined by the cam setting.

The selector cam setting is made by means of knob 46 which has a shaft 48 extending through a slot 50 in bracket 32. Cam 39 has a bore 52 through which the shaft 48 passes. A helical spring 54 passes over the shaft and bears against its enlarged end 56. This frictionally seats the cam 36 in bracket groove 38. Knob 46 seats in a recess 58 on bracket 34 to hold the cam in its selected lateral position. Repositioning the cam 36 is achieved by pulling rearwardly on knob 46 against spring 54 to remove it from recess 58. The knob can then be slid laterally to a new position where the action of the spring 54 locks it in recess 58 to insure against accidental lateral movement.

Cartridges 22 and 30 in FIG. 2 were shown in plan view, in position for stripping and chambering in chamber 16 of barrel 14. The position of these cartridges is shown in elevation in the sectional view of FIG. 3. Here cartridge 22 is held by its belt link 60 on sprocket 62 of sprocket assembly 20, in a position to be stripped and chambered in chamber 16 of barrel 14. Feeding guideways 64 are cut into each sprocket of sprocket assembly 20 to maintain positive round control throughout the chambering cycle. Sheet metal covers 66 surround the feed sprockets 62 and provide absolute round control as the belt is rotated into the primary feed position.

A ratchet 68 is assembled to the rear portion of the sprocket assembly 20. This ratchet rotates the assembly to position another cartridge, as bolt carrier 18 recoils, so that this cartridge will be chambered in chamber 16 by forward movement of bolt carrier 18 and rammer 24 (shown in FIG. 1).

Figure 3:
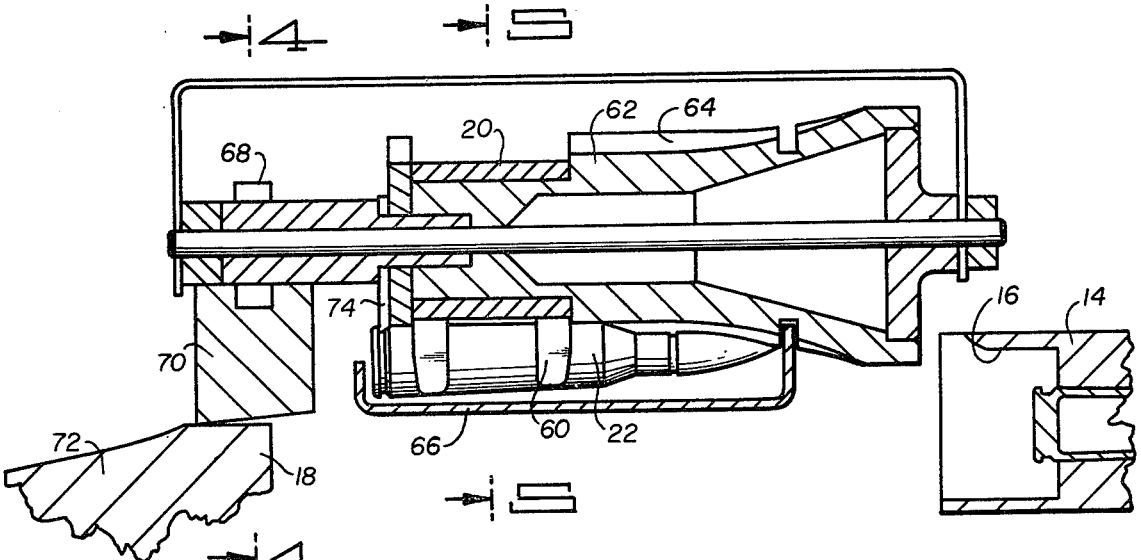
FIG. 3 is an elevational view taken in section along the longitudinal view of the axis of one of the sprocket assemblies.
Figure 4:
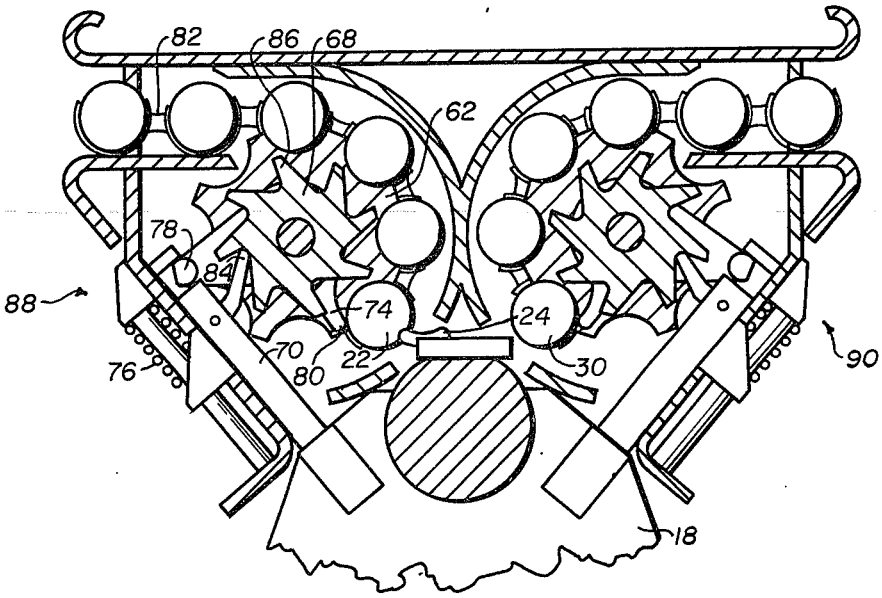
FIG. 4 is a sectional view of the ratchet feed mechanism taken along the line 4—4 of FIG. 3.

As will be shown more clearly in FIG. 4, a feed cam plate 70 is adapted to move upwardly in FIG. 3 to rotate ratchet 68 to advance the cartridges in position for stripping and firing. Bolt carrier 18 has a ramp 72 which engages and moves upwardly this feed cam plate 70 when the bolt carrier 18 recoils rearwardly. Each sprocket assembly, however, has a round sensor 74 that keeps feed cam plate 70 in its upward position when a cartridge is already in position for chambering and the bolt carrier is in forward or battery position. This also is more clearly shown in FIG. 4.

The dual ratchet feed mechanisms are shown in FIG. 4, which is a sectional view taken along the line 4—4 in FIG. 3. Since the rammer 24 on bolt carrier 18 is positioned to strip and chamber cartridge 22 from the left feed belt, the operation of the ratchet feed mechanism on the left will be described. As previously mentioned when bolt carrier 18 moves forwardly to battery position, because of ramp 72 on the carrier, feed cam plate 70 is permitted to move downwardly under the urging of spring 76. The forward movement of bolt carrier 18 with rammer 24 to the left, strips cartridge 22, leaving an empty space which is sensed by sensor 74. The absence of a cartridge permits counterrotation of the sensor 74 as the feed cam plate 70 moves downwardly under bias of spring 76 and when bolt carrier 18 is forward. Sensor 74 has a crank arm lever 78 which is pivotally connected to feed cam plate 70 and which rides with it as the sensor arm 80 rotates in a counterclockwise direction. However, if round 22 has not been stripped, such as when the rammer 24 has been pivoted to strip from the feed belt on the right side, the sensor 74 cannot counterrotate and thus holds feed cam plate 70 up in an inactive position, against the bias of spring 76, even when bolt carrier 18 is in forward or battery position.

The feeding of cartridges from the left cartridge belt 82 is accomplished by clockwise rotation of sprocket 62 on which the cartridge belt is fed. A feed ratchet 68 is connected to sprocket 62 to cause its rotation as feed cam plate 70 moves upwardly, upon rearward movement or recoil of bolt carrier 18. Feed cam plate 70 has a spring biased pawl 84 pivotally mounted thereon and engagable with the teeth 86 of ratchet 68. In this manner, upward movement of the feed cam plate 70 would cause sprocket 62 to rotate advancing the cartridge belt 82 to index another round into the ready to strip position. This cycle of operation will continue until the burst is interrupted, the feed belt on the right is chosen, or all the ammunition is spent. Since the right hand feed mechanism 88 is a mirror image of the left hand feed mechanism 90, and may be activated by pivoting rammer 24 to strip cartridge 30 from the right cartridge belt, further description of the right hand feed mechanism is not necessary.

Figure 5:
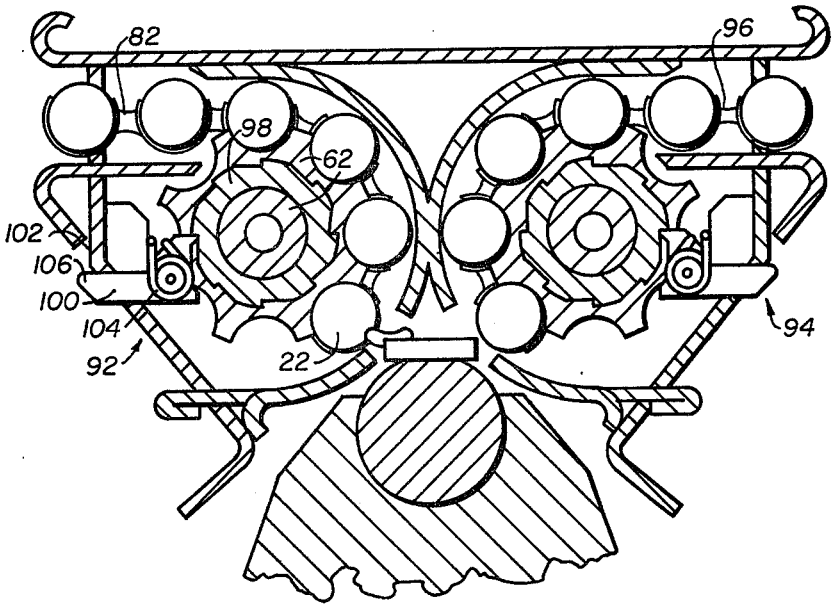
FIG. 5 is a sectional view of a non-reversing holding ratchet taken along the line 5—5 of FIG. 3.

FIG. 5 is a sectional view taken along the line 5—5 of FIG. 3. It shows the non-reversing holding ratchet structure 92 and 94 for the left and right cartridge belts 82 and 96 respectively. The left ratchet structure 92 includes a ratchet wheel 98 connected to feed sprocket assembly 20. A spring biased holding pawl 100 is mounted on the gun housing 102 with spring 104 urging the pawl against the ratchet wheel. As can be seen because of this holding ratchet structure left hand sprocket 62 can revolve in a clockwise direction only when the left ratchet feed mechanism is activated and holds belt 82 from withdrawal when the right ratchet feed mechanism is activated and the left is inactive. Pawl 100 has a lever 106 which may be depressed to free the pawl from the teeth of ratchet wheel 98 to permit rotation os sprocket 62 in a counterclockwise direction to disengage and remove ammunition belt 82, if desired.

Since the non-reversing holding ratchet structure 94 on the right is a mirror image of the structure 92 on the left, just described, its description is not necessary.

While an illustrative embodiment of the present invention has been described, modifications will become apparent to those skilled in the art and it is to be understood that these deviations from the embodiment described are to be considered as part of the invention as claimed.

What we claim is:

1. A dual selective feed mechanism for placing cartridges from a pair of ammunition belts into ready to feed positions and chambering cartridges from a selected belt in one of said positions to a chamber position for firing, said mechanism comprising:
   - a pair of feed sprocket assemblies for moving cartridges in a pair of belts into ready to feed positions,
   - a bolt carrier adapted to move forwardly to battery position,
   - a rammer pivotally mounted on said carrier and adapted to strip and chamber cartridges from either belt as said carrier moves to battery position, and selection means pivotally moving said rammer to strip and chamber cartridges from a selected belt.

2. A dual selective feed mechanism as set forth in claim 1 wherein said feed sprocket assemblies have feeding guideways thereon for guiding cartridges stripped by said rammer to said chamber position as said bolt carrier advances to battery position.

3. A dual selective feed mechanism as set forth in claim 1 wherein said selection means includes a round selector cam having inclined surfaces selectively positionable rearwardly of said rammer to deflect said rammer in a desired direction when struck thereby upon rearward recoil movement of said bolt carrier.

4. A dual selective feed mechanism as set forth in claim 1, and a sensor device responsive to a cartridge remaining in ready to feed position as said bolt carrier moves forwardly to battery position for stopping movement of the belt having said cartridge therein.

5. A dual selective feed mechanism as in claim 1, and ratchet means operable upon recoil of said belt carrier for rotary advancing the cartridge belt and replacing stripped cartridges in one of said ready to feed positions with cartridges from said selected belt.

6. A dual selective feed mechanism as in claim 5 including a non-reversing holding ratchet on each sprocket assembly and pawl means engageable with said holding ratchet to prevent counterrotation thereof.

7. A dual selective feed mechanism as in claim 1 wherein each feed sprocket assembly includes a sprocket connected indexing ratchet wheel, a feed cam plate actuated by rearward movement of said bolt carrier as it recoils from firing, said feed cam plate being operable to rotate said indexing ratchet wheel whereby said ratchet wheel rotates in response to rearward movement of said bolt carrier.

8. A dual selective feed mechanism as in claim 7 wherein said feed cam plate has a pawl thereon engageable with said ratchet wheel to provide rotation thereof.

9. A dual selective feed mechanism as in claim 8 wherein said bolt carrier has a camming surface thereon for reciprocating said feed cam plate as said bolt carrier reciprocates.

10. A dual selective feed mechanism as set forth in claim 9 wherein a sensing device is connected to and immobilizes said feed cam plate when a cartridge remains in said ready to feed position as said bolt carrier moves forward to battery position.

* * * * *